US006380904B1

(12) United States Patent
Ogawa

(10) Patent No.: US 6,380,904 B1
(45) Date of Patent: Apr. 30, 2002

(54) ANTENNA APPARATUS

(75) Inventor: Takaya Ogawa, Kawasaki (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 21 days.

(21) Appl. No.: 09/669,858

(22) Filed: Sep. 27, 2000

(30) Foreign Application Priority Data

Sep. 30, 1999 (JP) ..... 11-278219

(51) Int. Cl.[7] ..... H01Q 19/06
(52) U.S. Cl. ..... 343/754; 343/872; 343/911 L
(58) Field of Search ..... 343/753, 754, 343/757, 872, 873, 909, 911 R, 911 L; H01Q 19/06

(56) References Cited

U.S. PATENT DOCUMENTS 4,531,129 A 7/1985 Bonebright et al. ..... 343/754
5,748,151 A * 5/1998 Kingston et al. ..... 343/911 L
5,838,276 A 11/1998 Chapman et al. ..... 342/35

FOREIGN PATENT DOCUMENTS

EP 0 707 356 A1 4/1996
FR 2 770 343 4/1999
WO WO 93/02486 2/1996

OTHER PUBLICATIONS

C.M. Johnson, "Millimeter Wave Search System", IBM Technical Disclosure Bulletin, US, IBM Corporation, New York, vol. 5, No. 8, Jan. 1, 1963, pp. 105–106.

* cited by examiner

*Primary Examiner*—Michael C. Wimer
(74) *Attorney, Agent, or Firm*—Oblon, Spivak, McClelland, Maier & Neustadt, P.C.

(57) ABSTRACT

A foaming material is charged between a spherical lens and a radome, to form a foaming material layer, thereby to connect the both and support the spherical lens from the side of the radome, in order to provide an easily manufacturing and assembling method having excellent electrical properties, when providing an antenna capable of tracking a plurality of communication satellites and being installed in compact in a relatively small space. The foaming material layer is set at the same dielectric constant as that of the spherical lens or lower than that. Since the radome supports the spherical lens, any special supporting instrument is not necessary. Electrical deterioration occurs to the radome only, not to the supporting instrument. Generally, the radome is little affected by the electrical deterioration and the permeability of the electric waves is uniform, the permeable electric waves are hardly affected.

12 Claims, 7 Drawing Sheets

ANTENNA APPARATUS

CROSS-REFERENCE TO RELATED APPLICATIONS

This application is based upon and claims the benefit of priority from the prior Japanese Patent Application No. 11-278219, filed Sep. 30, 1999, the entire contents of which are incorporated herein by reference.

BACKGROUND OF THE INVENTION

The present invention relates to an antenna capable of capturing and tracking a plurality of communication satellites at once, which is employed on a ground station of a satellite communication system.

At the present, about 200 communication orbiting satellites are being launched on the earth, and it is possible to communicate with, at least, some satellites from any point on the earth. As a satellite communication system using these communication orbiting satellites, an iridium system and a sky-bridge system are proposed and being developed for practical use.

In this satellite communication system, since an orbiting satellite passes the empyrean in ten minutes or so, it is necessary to sequentially switch a satellite of the communication party in order to establish a sequential communication in the ground station. Therefore, a plurality of antennas capable of capturing and tracking communication orbiting satellites must be prepared in the ground station. While one antenna is tracking one satellite and communicating with the same satellite, another antenna starts capturing and tracking another orbiting satellite and switches the communication party before failing in communication with the former satellite.

In the conventional antenna capturing and tracking an orbiting satellite, a parabola-typed or phased array-typed antenna portion is mounted on a driving control mechanism for rotating the antenna portion around the azimuth axis, or elevation axis. This driving control mechanism turns the antenna portion in accordance with the movement of a satellite of the communication party, thereby directing the antenna beam toward the direction of the satellite.

The above-mentioned satellite communication system employs a plurality of the above-mentioned antennas as the facilities of the ground station, and it is necessary to locate each antenna not to block each antenna beam. For example, when locating two parabolic antennas each having the round reflex mirror of 45 cm diameter, it is necessary to locate them at a distance of about 3 m, in order not to block each beam in the horizontal direction.

Thus, a large space is required in order to set a plurality of antennas, and it is extremely difficult to set them in a general domestic site or house. Therefore, an antenna that can track a plurality of communication satellites and that can be set compactly in a relative small space is desired, in order to spread the satellite communication system into a general domestic use when starting the operation of the satellite communication system. Further, an easily manufacturing and assembling method is desired in the manufacture of the antenna.

BRIEF SUMMARY OF THE INVENTION

As mentioned above, the conventional orbiting satellite capturing and tracking antenna can track only one satellite. Therefore, it is necessary to use a plurality of antenna in order to capture and track a plurality of communication orbiting satellites at once. In this case, each antenna must be positioned at a good distance not to block each other, thereby requiring a large space for installation. Thus, an antenna that can capture and track a plurality of communication satellites and that can be set compactly in a relative small space is desired, in order to spread the satellite communication system widely. Further, an easily manufacturing and assembling method of the antenna is desired in the manufacturing process of the antenna.

An object of the present invention is, in order to realize the above requirements, to provide a method of manufacturing and assembling the antenna at ease improved in electrical property, when providing an antenna that can capture and track a plurality of communication orbiting satellites at once and that can be set compactly in a relative small space.

In order to solve the above problems, an antenna related to the present invention comprises a spherical lens for concentrating electronic waves; a plurality of transmitting and receiving modules of moving independently at a substantially constant distance from a bottom hemispheric surface of the spherical lens; a driving unit for moving the plurality of transmitting and receiving modules to arbitrary positions; and a radome for covering at least a top hemispheric surface that becomes an electric beam forming surface of the spherical lens, in which a foaming material layer is interposed to integrate the spherical lens and the radome and the radome is adopted to support the spherical lens.

According to the above configuration, since a plurality of power supplying portions can be arranged on one spherical lens, the antenna can track a plurality of communication satellites and it can be set in a small space. Furthermore, since it is unnecessary to provide a supporting member for supporting the spherical lens in the main body of the antenna, the antenna can be made more compact. In addition, since the supporting member is not required, wave beam is prevented from being disturbed by the supporting member and it is made possible to swing wave beam up to a low wave angle, so that it becomes possible to enlarge an allowable range of a plurality of power supplying devices over the whole area of a spherical lower face of the spherical lens.

The foaming material is formed of material having a dielectric constant lower than that of the spherical lens. Thereby, influence on radio wave beam can substantially cancelled.

A plurality of concave portions and a plurality of convex portions to be fitted to (be engaged with) each other in a depth much smaller than the wavelength of radio wave beam are formed at least on one side, between the spherical lens and the foaming material layer and between the foaming material layer and the radome. According to this structure, joining strength between the spherical lens and the foaming material layer or between the foaming material layer and the radome can be increased without affecting radio wave beams.

In a method for integrally forming a spherical lens and a radome for the antenna, foaming material is filled in a space between the spherical lens and the radome in a state where the spherical lens and the radome are positioned. According to this method, since the spherical lens and the radome can be formed in an integral manner, for example, at an installation place of the antenna, the transportability of respective parts of the antenna is improved, it is made easy to assemble the antenna, and working in site is made easy.

In an assembling method, after the spherical lens is positioned in a state where the radome is reversed, foaming material is filled between the spherical lens and the radome so as to integral them with each other, and the radome is fixed at a predetermined portion of the main body. According to this method, filling work is made easy.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, an embodiment of the present invention will be described in detail with reference to the drawings.

Figure 1:
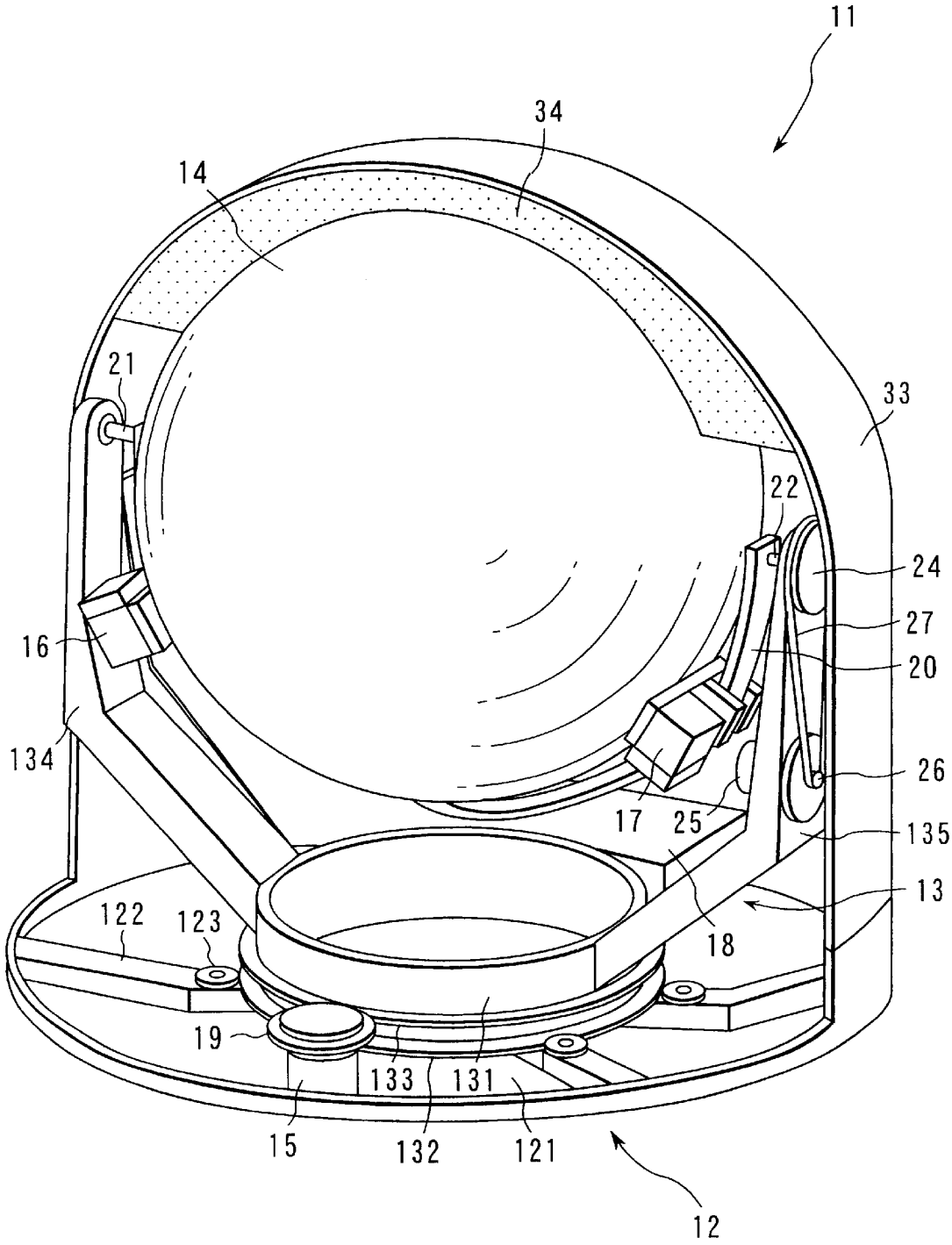
FIG. 1 is a perspective view showing the structure of an antenna according to an embodiment of the present invention.
Figure 2:
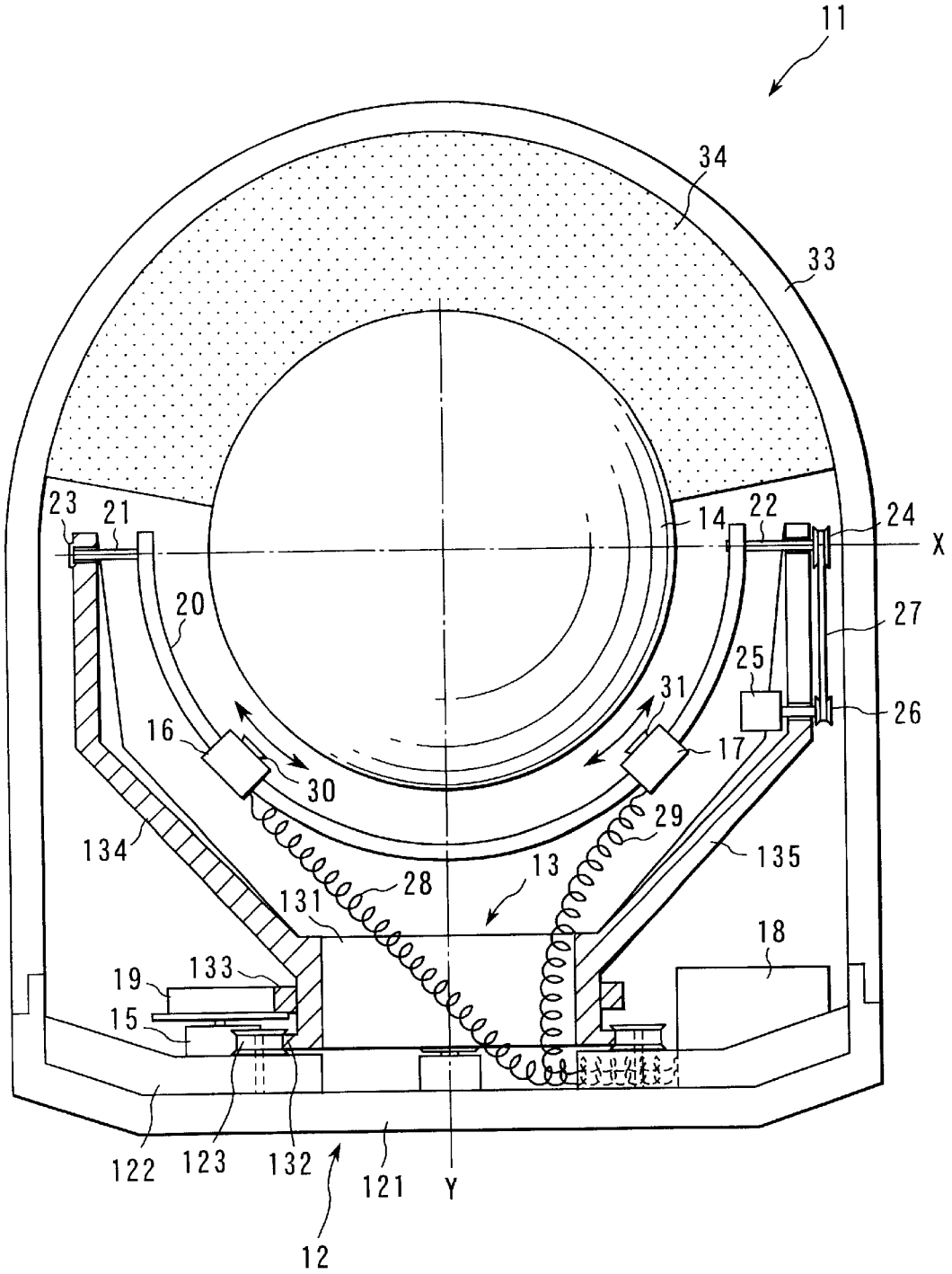
FIG. 2 is a partly cross sectional view according to the same embodiment.

FIGS. 1 and 2 are schematic constitutional views showing an antenna 11 according to an embodiment of the present invention; FIG. 1 is a perspective view showing a partly broken portion, and FIG. 2 is a partly cross sectional view.

In FIGS. 1 and 2, the antenna 11 according to the embodiment of the present invention is designed in that a substantially circular rotary base 13 is mounted on a substantially circular fixed base 12 around a first axis of rotation (azimuth axis) Y in a rotatable way and that a spherical lens 14 is adjusted to dispose its center on the first rotation axis Y.

The fixed base 12 is designed in that some timbers 122 extending from the peripheral portion toward the center are formed on a basement 121 fixed on the ground or a building and that a bearing 123 for pulley is mounted on the distal end of each timber 122. Further, on the basement 121, a motor 15 for rotating the rotary base 13 and a transmitting and receiving module controller 18 for feeding the power to a pair of transmitting and receiving modules 16 and 17 described later, transmitting and receiving a signal to and from it, and performing a positioning control on it are positioned between the timbers 122. The motor 15 is mounted in a way of directing the rotation axis thereof upwardly in the drawings and a roller 19 is mounted on the rotation axis.

The rotary base 13 is engaged with the above bearing 123 at the bottom of a cylindrical supporter 131, a projecting portion 132 for supporting the whole rotary base 13 in a rotatable way is integrated with the rotary base 13 and a projecting portion 133 for rotating the whole rotary base 13 in close contact with the roller 19 by the rotation of the roller 19 which is mounted on the rotation axis of the motor 15 is integrated with the rotary base 13 around the peripheral surface thereof. Further, on the lateral side of the supporter 131, a pair of arms 134 and 135 are integrated with the rotary base 13 at the opposite positions of the first rotation axis Y. These arms 134 and 135 are extended from the supporter 131 along the surface of the spherical lens 14 in a U-shape, and the distal end portions of the arms are placed at the position corresponding to the center of the spherical lens 14, on a second axis of rotation (elevation axis) X at a right angle of the first rotation axis.

A through hole is formed on each distal end portion of the pair of arms 134 and 135 at the position corresponding to the second rotation axis X. Supporting pins 21 and 22 fixed on the both end portions of a guide rail 20 are inserted into these through holes. The guide rail 20 is formed in an arc shape at a constant distance from the center of the spherical lens 14, and supported in a rotatable way around the second rotation axis X by inserting the supporting pins 21 and 22 into the through holes of the pair of the arms 134 and 135.

The supporting pin 21 fixed on one end portion of the guide rail 20 is inserted into the through hole of the arm 134, and a washer ring 23 is attached to the end portion so as not to drop the pin 21. The supporting pin 22 fixed on the other end of the guide rail 20 is inserted into the through hole of the arm 135, and a pulley 24 is mounted on the other end so as not to drop the pin 22. Another through hole is formed below the through hole of the arm 135 in parallel to the same through hole, and an elevation angle adjustment motor 25 is mounted on the arm 135 in a way of inserting its axis of rotation into this through hole. A pulley 26 of smaller diameter than that of the pulley 24 is mounted on the end portion of the rotation axis of the motor 25, and a belt 27 is provided between the pulley 24 and the pulley 26. Thus, the rotation of the motor 25 is transmitted to the supporting pin 22 through the pulley 26, the belt 27, and the pulley 24, in a way of being decreased in speed, thereby rotating the guide rail 20 around the second rotation axis X.

A pair of transmitting and receiving modules 16 and 17 are automatically installed in the guide rail 20. Though there are various methods of automatic installation mechanism, as it is not directly related to the present invention, the description thereof is omitted here. The transmitting and receiving modules 16 and 17 are connected to the controller 18 respectively by curl codes 28 and 29, so as to freely run on the guide rail 20 according to a driving control signal from the controller 18 and stop at a specified position. The respective transmitting and receiving modules 16 and 17 are provided with box-shaped antenna elements 30 and 31 on the opposite surface of the is spherical lens 14, which are adopted to turn the beam toward the center of the spherical lens 14. Electric waves are radiated toward the center of the spherical lens 14 and the electric waves returning from the direction of the spherical lens 14 are received, by providing the power from the controller 18 to the antenna elements 30 and 31.

The above-mentioned structure is fully covered with a cup-shaped radome 33, and the bottom of the radome 33 is jointed to the peripheral portion of the basement 121. This radome 33 is made of the material having the permeability of electric waves and the low heat conductivity, for example, resin.

Figure 3:
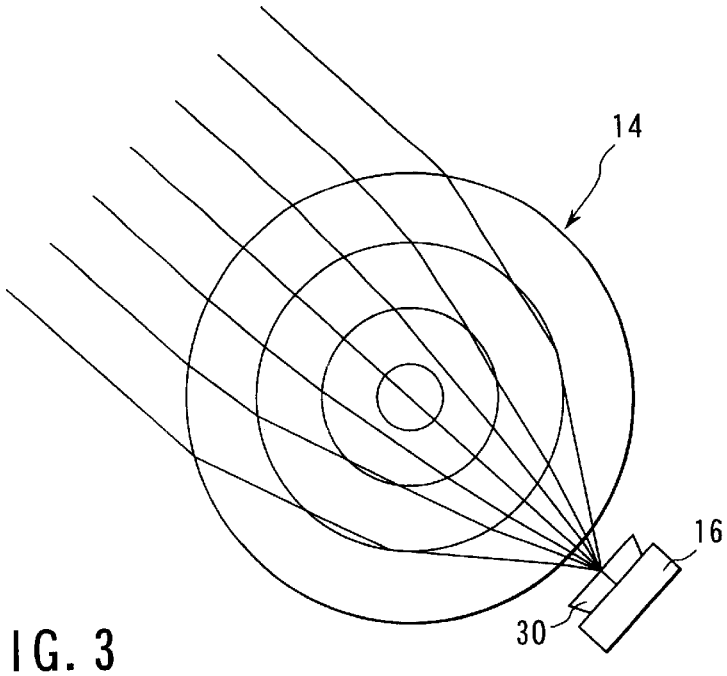
FIG. 3 is a schematic view showing the function of a spherical lens according to the same embodiment.

The spherical lens 14 is also called a spherical dielectric lens, and the dielectric substance is layered on the spherical surface thereof, so as to concentrate the electric waves passing this layer in almost parallel on one point. FIG. 3 is a schematic view showing the function of the spherical lens 14. Although the spherical lens 14 shown in FIG. 3 has the four-layers structure, the number of the layers of dielectric is not restricted to this. In the spherical lens 14, generally the dielectric constant of the layered dielectric becomes lower in the outer layer. Because of the difference in the dielectric conductivity of each layer, the permeable electric waves can be refracted in the same way as in the optical lens. Foaming material such as polystyrene (expanded polystyrene) is used for each layer and the dielectric constant is varied by changing the foaming rate.

The transmitting and receiving module controller 18 is connected to a host unit (not illustrated) positioned within a house, information relative to the position of a satellite is entered from the host unit so as to require where to place the two transmitting and receiving modules 16 and 17, and the first rotation axis driving motor 15 and the second rotation axis driving motor 25 are driven so as to place the transmitting and receiving modules 16 and 17 at the corresponding positions, where the respective modules 16 and 17 are to be freely run.

Figure 4:
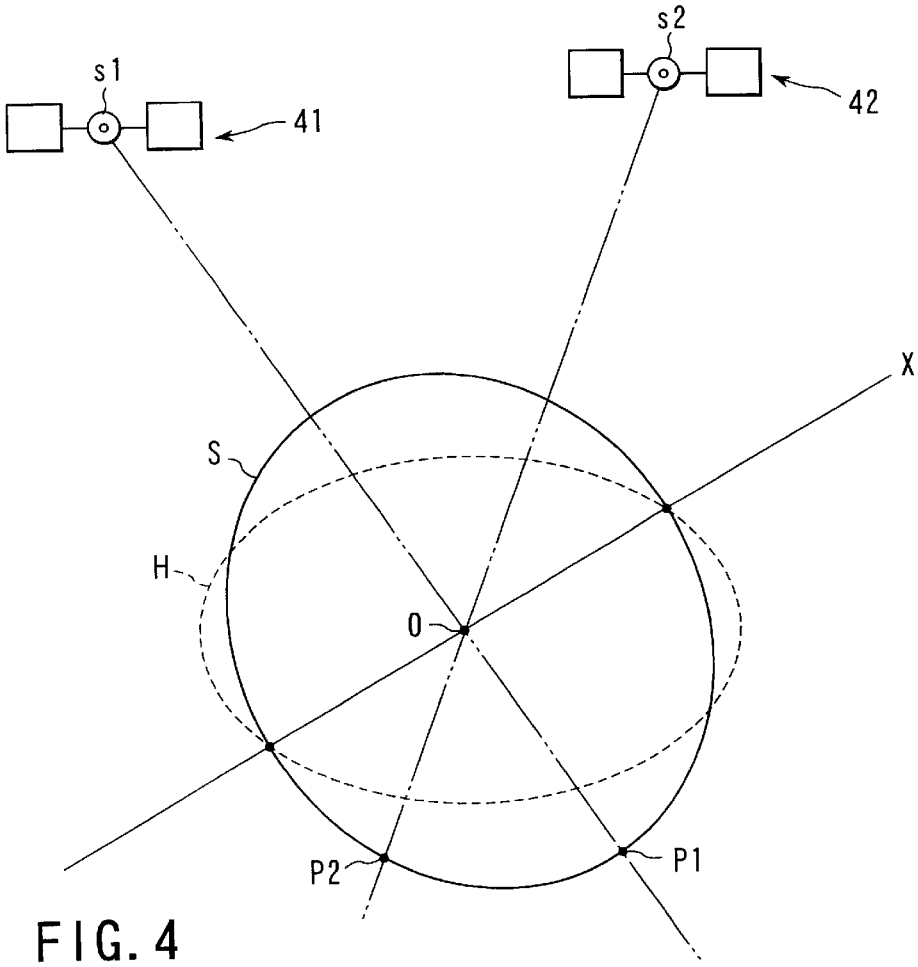
FIG. 4 is a perspective view showing the outline of a positioning control of transmitting and receiving module according to the same embodiment.
Figure 5:
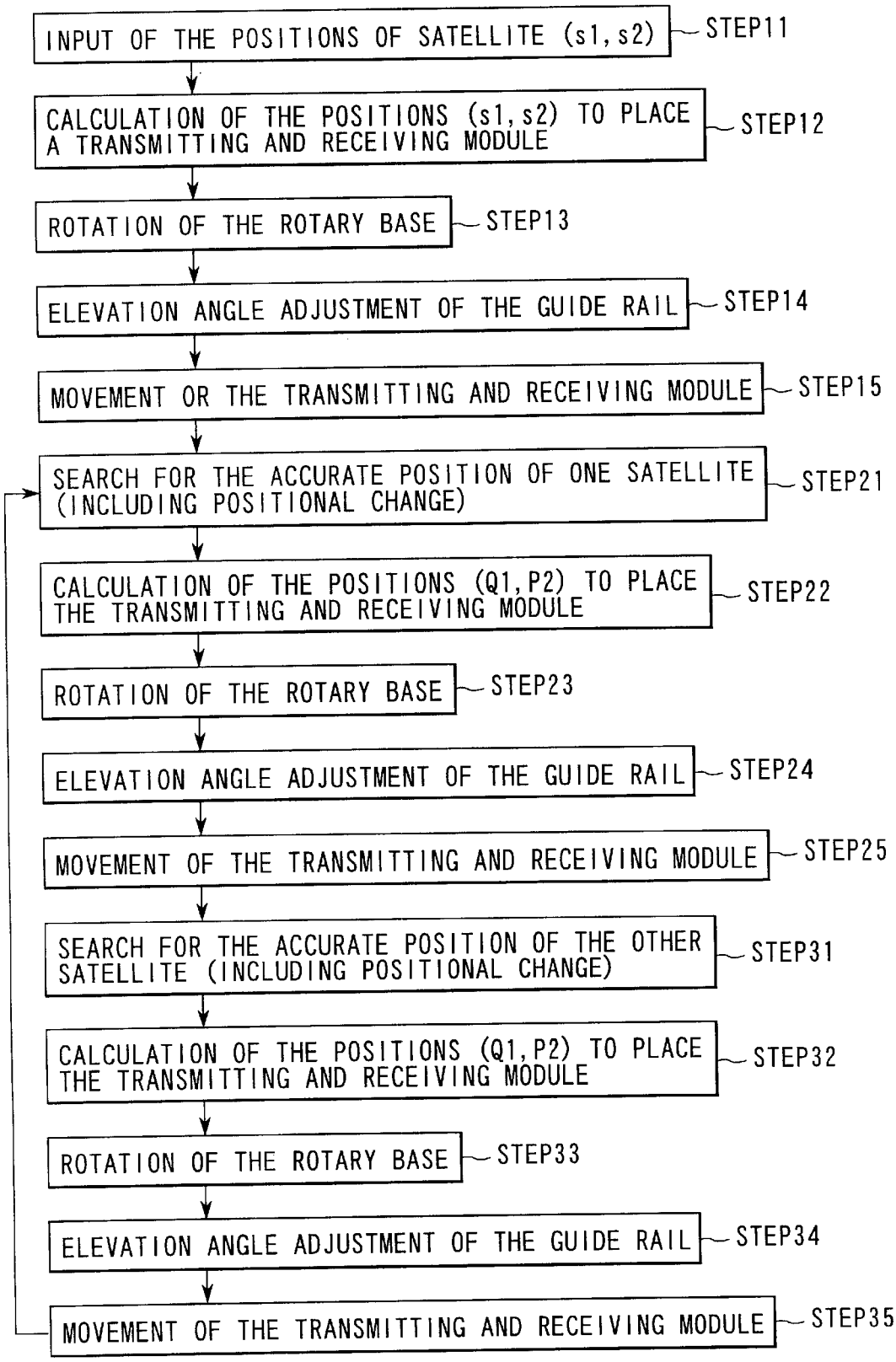
FIG. 5 is a flow chart showing the outline of the positioning control of the transmitting and receiving module according to the same embodiment.

The function of an antenna according to the above structure will be described with reference to FIGS. 4 and 5. FIG. 4 is a perspective view showing the outline of a positioning control of a transmitting and receiving module, and FIG. 5 is a flow chart showing the procedure of the positioning control of a transmitting and receiving module.

At first, rough positions s1 and s2 of two selected satellites 41 and 42 capable of communication are supplied from the host unit to the controller 18 (STEP 11).

As illustrated in FIG. 4, the controller 18 computes two positions P1 and P2 where the transmitting and receiving modules 16 and 17 (more specifically, the antenna elements 30 and 31 thereof) should be placed, in order to place the two transmitting and receiving modules 16 and 17 on a1 and a2 extending from the supplied positions s1 and s2 of the two satellites through the center of the spherical lens 14 (STEP 12).

The controller 18 rotates the rotary base 13 by driving the motor 15, so as to place the second rotation axis X on the intersections of a first virtual plane S including the two positions P1 and P2 where the transmitting and receiving modules 16 and 17 should be positioned and the center O of the spherical lens 14, and a second virtual plane H standing at a right angle of the first rotation axis Y of the rotary base 13, as well as passing through the center of the spherical lens 14 (STEP 13).

Continued to the rotation of the rotary base 13, or at the same time of the rotation of the rotary base 13, the controller 18 drives the elevation angle adjustment motor 25, so as to rotate the guide rail 20 around the second rotation axis X so as to overlay the guide rail 20 on the positions P1 and P2 (STEP 14).

Continued to the drive of the elevation angle adjustment motor 25, or at the same time of the drive of the elevation angle adjustment motor 25, the controller 18 runs the transmitting and receiving modules 16 and 17 on the guide rail 20, to move them to the positions P1 and P2 (STEP 15). This can achieve the initial positioning of the transmitting and receiving modules 16 and 17.

The two orbiting satellites 41 and 42 move on the orbit in about 10 minutes from the time of appearance to the time of disappearance on the horizontal. The antenna 11 according to the form of the present invention tracks the satellites s1 and s2 moving at a rapid speed, as follows.

After achievement of the initial positioning, the more accurate position about one of the two satellites 41 and 42, for example, the satellite 41 (including also the position after movement) is searched (first search process: STEP 21). The position of the satellite 41 is searched as follows.

The elevation angle adjustment motor 25 is bidirectionally rotated in trace amounts, so as to rotate the guide rail 20 bidirectionally around the second rotation axis X in trace amounts, and at the same time to move the transmitting and receiving module 16 that is positioned on the guide rail 20 correspondingly to the satellite 41, bidirectionally in trace amounts. This can move the transmitting and receiving module 16 within two-dimensional small spherical surface.

During the movement within this spherical surface, a point Q1 that can obtain good communication between the satellite 41 and the transmitting and receiving module 16 is searched. The state, good or poor, of the communication can be judged by monitoring the strength of a received signal. The point Q1 can be judged to be positioned on an axis extending from the more accurate position of the satellite 41 through the center O of the spherical lens 14. Namely, the search for the point Q1 can tell the more accurate position of the satellite 41.

Positions on each axis extending from the position of the satellite 41 searched in the first search process through the center O of the spherical lens 14 and extending from the position of the other satellite 42 before a search for the positional change in the first search process through the center O of the spherical lens 14, are computed. In this case, the two positions Q1 and P2 are recognized (STEP 22).

The motor 15 is driven to rotate the rotary base 13, so as to place the second rotation axis X on the intersections of the second virtual plane H and the first virtual plane S including the two positions Q1 and P2 where the transmitting and receiving modules 16 and 17 should be positioned next as well as the center O of the spherical lens (STEP 23).

Continued to the rotation of the rotary base 13, or at the same time of the rotation of the rotary base 13, the controller 18 drives the elevation angle adjustment motor 25, so as to rotate the guide rail 20 around the second rotation axis X so as to overlay it with the positions Q1 and P2 (STEP 24).

Continued to the drive of the elevation angle adjustment motor 25, or at the same time of the drive of the elevation angle adjustment motor 25, the controller 18 moves the transmitting and receiving modules 16 and 17 to the positions Q1 and P2 along the guide rail 20 (STEP 25). This can achieve the tracking positioning of the transmitting and receiving module 16 while preserving the position P2 of the transmitting and receiving module 17. The form of this control is to be called a non-interacting control.

After achievement of the tracking positioning of the transmitting and receiving module 16, the more accurate position of the other satellite 42 at the time (including the position after positional change), of the two satellites 41 and 42, is searched (second search process: STEP 31). The search for the position of the satellite 42 is performed in the same way as in the search for the position of the satellite 41.

Positions on each axis extending from the position of the satellite 42 searched in the second search process through the center O of the spherical lens 14 and extending from the position of the satellite 41 before the search for the position in the second search process (after the search for the position in the first search process) through the center O of the spherical lens 14, are computed. In this case, two positions Q1 and Q2 are recognized (STEP 32).

The motor 15 is driven so as to rotate the rotary base 13 so as to place the second rotation axis X on the intersections of the second virtual plane H and the first virtual plane S including the two positions Q1 and Q2 where the transmitting and receiving modules 16 and 17 should be positioned next as well as the center O of the spherical lens 14 (STEP 33).

Continued to the rotation of the rotary base 13, or at the same time of the rotation of the rotary base 13, the controller 18 drives the elevation angle adjustment motor 25, to rotate the guide rail 20 around the second rotation axis X so as to overlay the guide rail 20 with the positions Q1 and Q2 (STEP 34).

Continued to the drive of the elevation angle adjustment motor 25, or at the same time of the drive of the elevation angle adjustment motor 25, the controller 18 moves the transmitting and receiving modules 16 and 17 to the positions Q1 and Q2 along the guide rail 20 (STEP 35). This can achieve the tracking positioning of the transmitting and receiving module 17 non-interactively while preserving the position Q1 of the transmitting and receiving module 16.

Hereinafter, it is possible to track the two satellites 41 and 42 sequentially, by sequential performance of the tracking positioning of the transmitting and receiving module 16 and the tracking positioning of the transmitting and receiving module 17 by turns. When the two satellites 41 and 42 approach each other and one passes the other, a satellite to be tracked is switched between the transmitting and receiving modules 16 and 17 at the passing point, thereby enabling a tracking control at ease.

If electric waves are radiated from the transmitting and receiving modules 16 and 17 positioned like this, the radiated waves are converted into the waves progressing in parallel, by passing through the layered dielectric substances sequentially, and they are sent to the satellites 41 and 42 as the parallel electric waves (refer to FIG. 3).

While the electric waves radiated in parallel from the satellites 41 and 42 are passing through the spherical lens 14, they are concentrated on the focus point where the transmitting and receiving modules 16 and 17 are placed and received efficiently by the transmitting and receiving modules 16 and 17 (refer to FIG. 3).

As mentioned above, in the antenna having the above structure, the two transmitting and receiving modules 16 and 17 are placed at the opposite side of one spherical lens 14, not to interfere with each movement, thereby enabling the tracking of the two satellites 41 and 42 at once and enabling installation in a small space.

The supporting structure of the spherical lens 14 becomes a problem. Namely, the spherical lens 14 is so heavy and spherical that it is difficult to support. Further, since the transmitting and receiving modules 16 and 17 are placed at any position on the side of bottom hemisphere of the spherical lens 14, it is impossible to support the spherical lens 14 on the bottom side thereof. Further, a supporting instrument necessarily blocks the surface of the electric wave passage, which causes deterioration in electrical property to the spherical lens 14. This requires the supporting structure having rigid strength enough to put up with the use environment as well as capable of keeping a preferable electrical property.

As a simple method, there are a supporting method of holding the spherical lens between the both sides, and a shaft using method of holding a shaft which is inserted into the spherical lens.

In the case of the supporting method, a supporting instrument for holding the spherical lens requires quite a strength enough to put up with the mass of the spherical lens. Even if the material of good permeability of electric waves is used for the supporting instrument, electrical deterioration is much increased. Especially, since the supporting portion is not symmetrical with respect to the axis in the whole directions, the supporting portion causes a bad effect of damaging the electrical symmetry about the axis that is the characteristic of the spherical lens. Further, since the spherical lens has a high foaming rate in the foaming material on its surface, it doesn't have a surface strength enough to support the whole mass.

On the other hand, in the case of the shaft using method, it is possible to manufacture the shaft using the same material at the same foaming rate as that of the inside layer of the spherical lens, and to maintain the strength enough to support the whole spherical lens. However, this method also deteriorates the electrical property. Since the shaft cannot be formed in symmetry with respect to the axis, this causes a damage to the electrical symmetry that is the characteristic of the spherical lens.

Then, taking notice of the radome 33 positioned on the upper portion of the spherical lens 14, the present invention is designed to combine the spherical lens 14 with the radome 33 by charging the foaming material between the spherical lens 14 and the radome 33 to form a foaming material layer 34, thereby supporting the spherical lens 14 from the side of the radome 33.

Besides polystyrene (expanded polystyrene), foaming polyurethane or foaming polyethylene, can be used as the foaming material for use in the foaming material layer 34. Although the glass fiber reinforced plastic (GFRP) can be generally used as the radome 33 itself, polyethylene can be also used depending on the case. This depends on the trade-off of the electrical property, formability, and mechanical property. Here, it is necessary to fix the dielectric constant of the foaming material layer 34 at the same dielectric constant as that of the outermost peripheral portion of the spherical lens 14 or at the lower dielectric constant than that of the outermost peripheral portion.

The curve rate of the radome 33 is not necessarily adjusted to that of the spherical lens 14 as far as it satisfies the electrical property, but the radome may be formed in semi-oval cross section. Although the thickness of the radome 33 is expressed uniformly in the figures, the bottom portion may be made thicker so as to ensure the strength.

If the conjunction of the spherical lens 14 and the radome 33 by the foaming material layer 34 is performed at the assembly site, the positional accuracy of the spherical lens 14 and the transmitting and receiving modules 16 and 17 can be gained.

The method of forming the foaming material layer 34 is shown in FIG. 6.

Figure 6A:
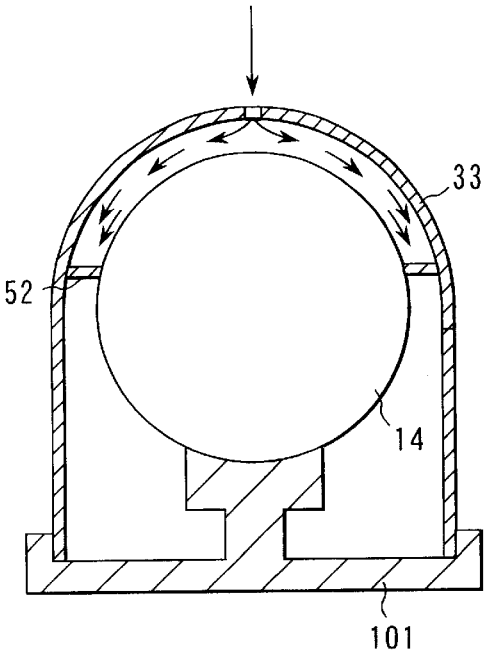
FIGS. 6A and 6B are cross sectional views each showing a method of forming a layer of foaming material used in the same embodiment.

In the method as shown in FIG. 6A, as first, a fringe portion 51*a* for fixing the radome 33 at the plane board is formed, a positioning supporting instrument 51 with a supporting base 51*b* for setting the position and the height of the spherical lens 14 is formed at the center, the spherical lens 14 is installed on the supporting base 51*b,* the radome 33 covers them downwardly, and it is fixed to the fringe portion 51*a*. At this time, a bulkhead plane ring 52 is set between the spherical lens 14 and the radome 33. A hole for injection is previously bored in the ceiling portion of the radome 33, and the foaming material is pressed into through this hole. After hardening the foaming material, the plane ring 52 is taken away from the foaming material and removed away from the supporting instrument 53, thereby completing the work of forming the foaming material layer. In this way, the foaming material layer 34 is formed between the spherical lens 14 and the radome 33, so as to combine the both.

Figure 6B:
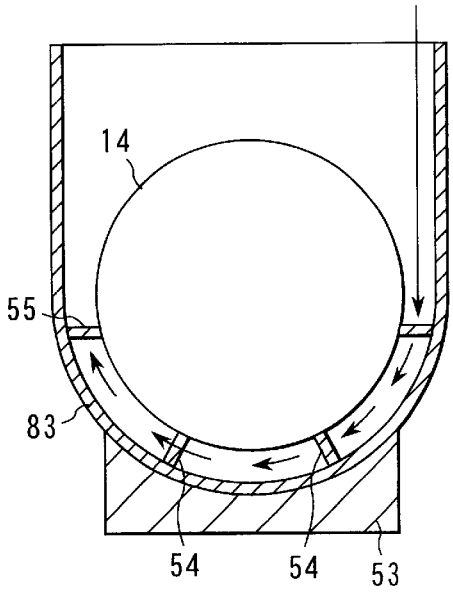

In the method as shown in FIG. 6B, the radome 33 is inserted, so as to be installed on the concave supporting instrument 53. At the bottom inside the radome 33, one or several cup-shaped projecting members 54 for positioning the spherical lens 14 are positioned, and the spherical lens 14 is installed thereon. A bulkhead plane ring 55 is set between the spherical lens 14 and the radome 33. A hole for injection is previously bored in one part of the plane ring 55, and the foaming material is pressed into through this hole. After hardening the foaming material, the plane ring 55 is taken away and removed away from the supporting instrument 53, thereby completing the work of forming the foaming material layer. In this way, the foaming material layer 34 is formed between the spherical lens 14 and the radome 33, so as to combine the both.

In the method as shown in FIG. 6B, although the projecting member 54 remains within the foaming material layer 34, the projecting member 54 is made of the material of high permeability, and it is formed into a cup-shape, so as to reduce the electrical influence much more.

Figure 7A:
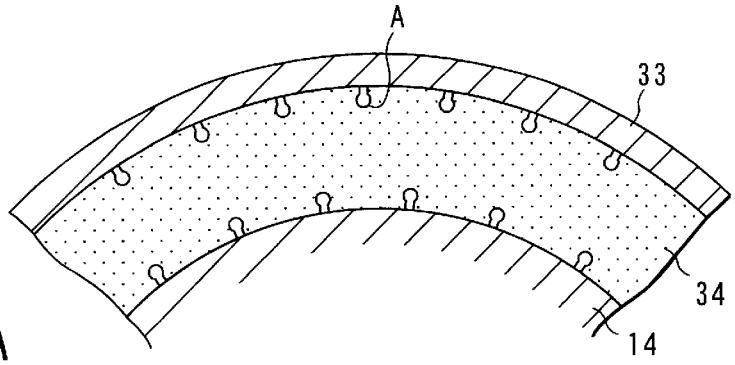
FIGS. 7A and 7B are cross sectional views for describing a method of enhancing the connection of the radome and the foaming material layer, and the connection of the spherical lens and the foaming material layer used in the same embodiment.
Figure 7B:
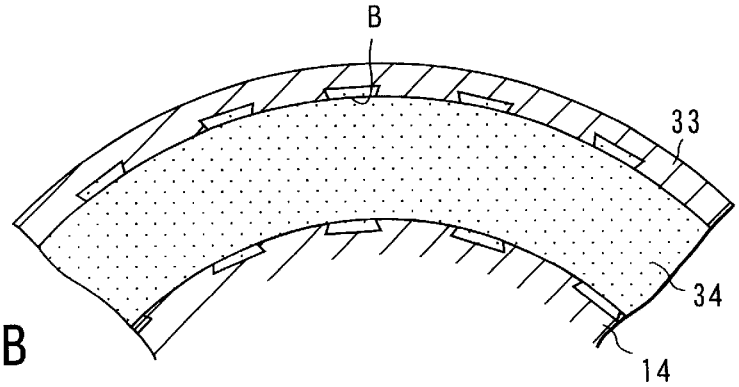

Here, as illustrated in FIG. 7A, if a lot of small projecting portions A are formed on the both sides of the spherical lens 14 and the radome 33 on the connected surface with the foaming material layer in advance, in order to enhance the connection of the spherical lens 14 and the foaming materially layer 34 and the connection of the radome 33 and the foaming material layer 34, more rigid connection of the both can be obtained after charge of the foaming material. Instead of the small projecting portion, as illustrated in FIG. 7B, if groove portions B are formed on the spherical lens 14 and the radome 33 on the connected surface with the foaming material layer, the area of the connected surface can be increased, thereby further enhancing the connecting strength.

Figure 8A:
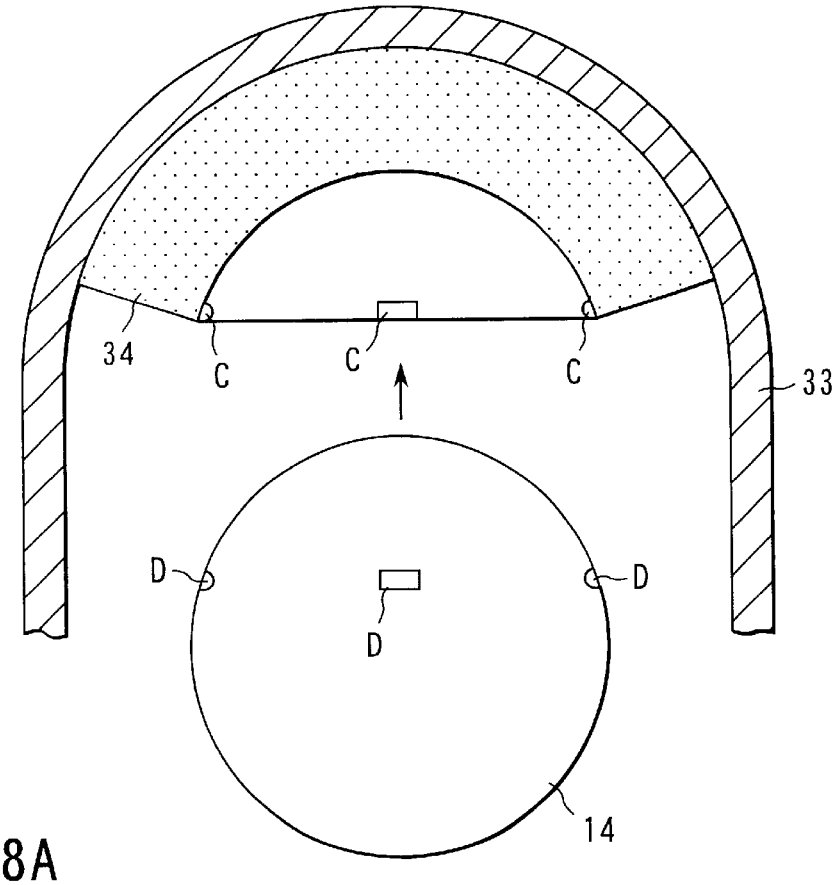
FIGS. 8A and 8B are cross sectional views for describing a method of enhancing the connection of the spherical lens and the foaming material layer used in the same embodiment.
Figure 8B:
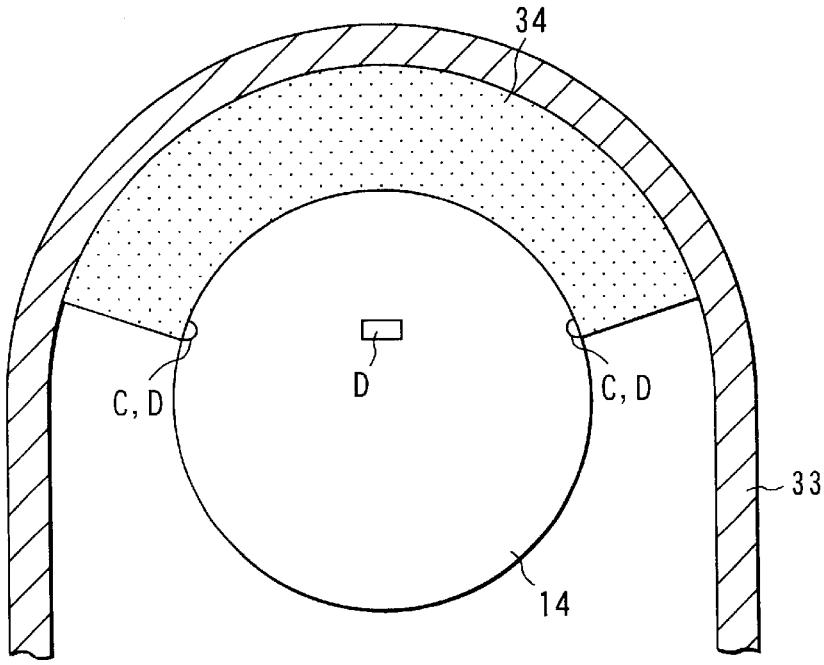

In the above-mentioned method, the foaming material is charged so as to directly connect the spherical lens 14 with the radome 33. Besides, there is a method of forming the foaming material layer 34 within the radome 33 in advance and adhering the spherical lens 14 by the adhesive having high permeability of electric waves. In the case where the connection by the adhesive cannot assure enough strength, a projecting portion C having a proper elasticity is formed on the foaming material layer 34 at one part or all the peripheral portion of the connected surface thereof with the spherical lens 14 as illustrated in FIG. 8A, and a concave portion D is formed on the spherical lens 14 on the connected surface thereof with the foaming material layer 34 at the opposite position of the projecting portion C. After applying the adhesive to the connected surface of the foaming material layer 34, the spherical lens 14 is in contact with the connected surface of the foaming material layer 34 by embedding the projecting portion C on the side of the foaming material layer 34 into the concave portion D on the side of the spherical lens 14 by use of the elasticity of the projecting portion C of the foaming material layer 34, as illustrated in FIG. 8B. In this way, embedding the projecting portion C into the concave portion D can reinforce the connection by the adhesive.

Figure 9A:
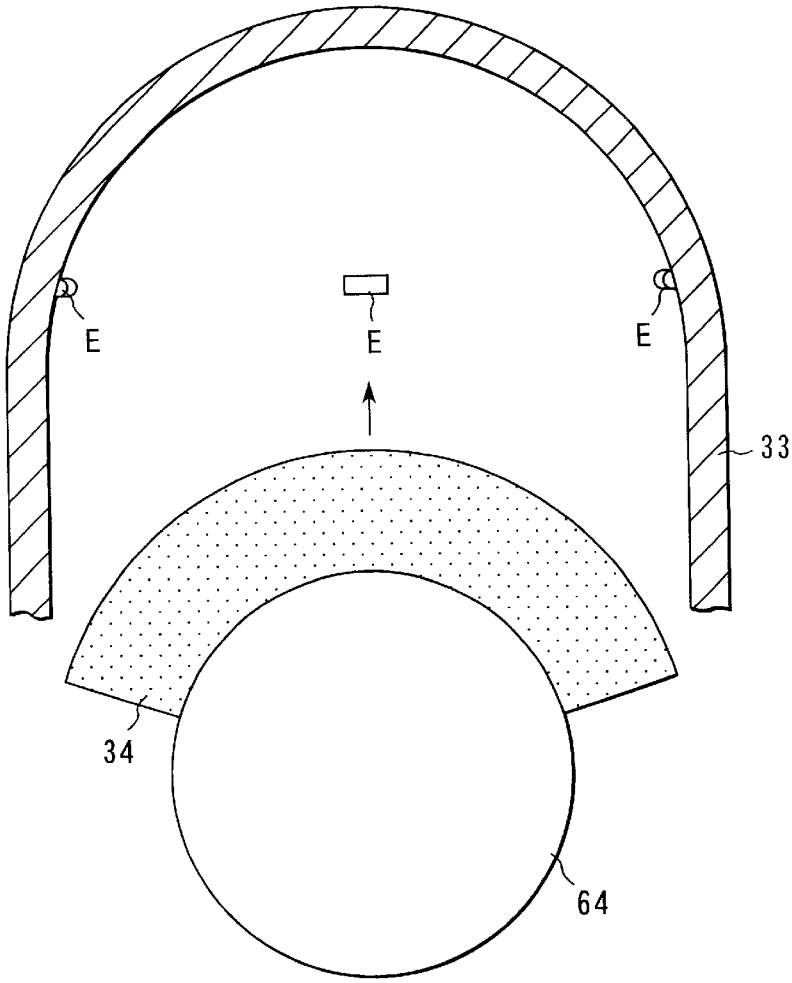
FIGS. 9A and 9B are cross sectional views for describing a method of enhancing the connection of the spherical lens and the foaming material layer used in the same embodiment.
Figure 9B:
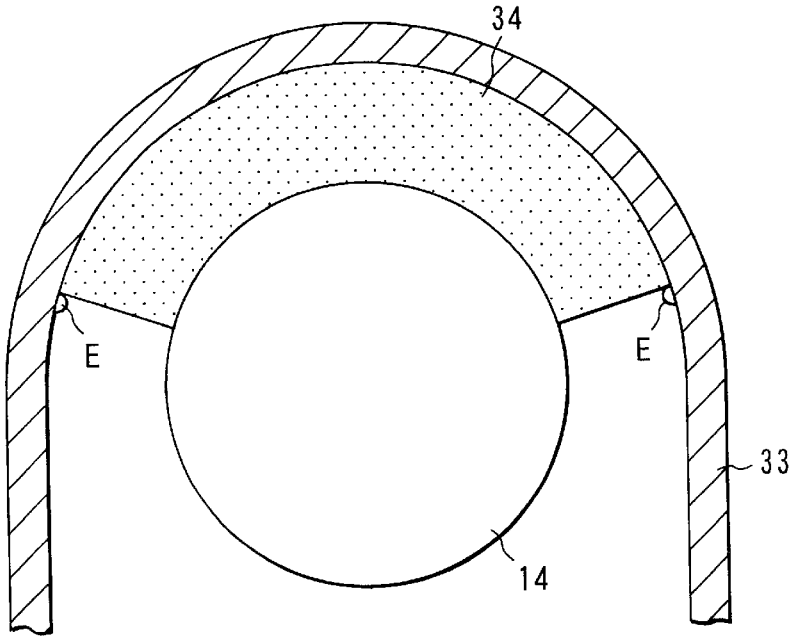

In the same way, there can be a method of forming the foaming material layer 34 integrally with the spherical lens 14 in advance and connecting the connected surface of the foaming material layer 34 to the inside of the radome 33 by the adhesive, and in addition to the above method, a method of forming a projecting portion E at a plurality of positions or all around the peripheral surface inside the radome 33 as illustrated in FIG. 9A and supporting the end portion of the foaming material layer 34 by the projecting portion E when connecting the foaming material layer 34 to the inside surface of the radome 33 as illustrated in FIG. 9B.

As mentioned above, the present invention, in which the spherical lens 14 is connected to the radome 33 through the foaming material layer 34, can support the spherical lens 14 without preparing any supporting structure in the rotary base 13. In this case, the following characteristic effects can be obtained.

Since the radome 33 supports the spherical lens 14, any particular supporting instrument is not necessary. The electrical deterioration occurs to the radome 33 only, not to the supporting instrument. Since the radome 33 is generally affected by the electrical deterioration only a little and its permeable ratio of electric waves is uniform, the permeable electric waves are little affected.

Since the radome 33 is designed to surround the spherical lens 14 so as to support the whole lens, no deviation occurs and the electrical symmetry around the axis that is the characteristic of the spherical lens 14 can be assured.

Since the foaming material layer 34 intervening between the radome 33 and the spherical lens 14 is designed at the dielectric constant lower than that of the outermost layer of the spherical lens 14, no electrical deterioration occurs to the spherical lens 14.

Since the foaming material layer 34 and the spherical lens 14 are in close contact with the inside surface of the radome 33, it can serve to reinforce the half top portion of the radome having the thin plate structure. This effect can make the thickness of the plate of the radome thinner than that of the conventional one, thereby decreasing the electrical deterioration much more.

The foaming material layer 34 can serve to protect the fragile surface of the spherical lens. This is effective in preventing from damaging at the manufacturing time or assembly time. Further, since the spherical lens 14 is extremely heavy and in spherical shape, it is difficult to handle it at the manufacturing time and the assembly time. However, it is integrated with the radome 33, which makes handling easy.

Since the foaming material layer 34 functions as a heat insulator, it is effective in restraining an increase of the inside temperature due to the sunlight.

As set forth hereinbefore, the present invention can provide an antenna capable of tracking a plurality of communication satellites, being installed in compact in a relatively small space, and manufacturing and assembling at ease.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna comprising:

a spherical lens for concentrating electronic waves;

a plurality of transmitting and receiving modules of moving independently at a substantially constant distance from a bottom hemispheric surface of said spherical lens, for forming electric waves toward the center of said spherical lens and its supporting/driving mechanism; and a radome for covering at least a top hemispheric surface that becomes an electric beam forming surface of said spherical lens;

wherein a foaming material layer is interposed to integrate said spherical lens and said radome and said spherical lens is supported by said radome.

2. An antenna as claimed in claim 1, wherein said foaming material is made of a material having the same dielectric constant as that of said spherical lens or lower than that.

3. An antenna as claimed in claim 1, wherein a plurality of concave portions and convex portions to be engaged with each other, in a depth much smaller than the wavelength of the electric beam, are formed at least on one side, between said spherical lens and said foaming material layer or between said foaming material layer and said radome.

4. An antenna as claimed in claim 1, wherein a convex portion is formed on said foaming material layer all over the peripheral portion or at a plurality of positions of a connected surface thereof with the said spherical lens and a concave portion to be engaged with the convex portion is formed on said spherical lens at a corresponding position to the convex portion.

5. An antenna as claimed in claim 1, wherein a projecting portion is formed on said radome all over the peripheral portion or at a plurality of positions of a connected surface thereof with the foaming material layer.

6. A spherical lens supporting method for use in an antenna comprising:

a spherical lens for concentrating electronic waves;

a plurality of transmitting and receiving modules of moving independently at a substantially constant distance from a bottom hemispheric surface of said spherical lens, for forming electric waves toward the center of said spherical lens and its supporting/driving mechanism; and a radome for covering at least a top hemispheric surface that becomes an electric beam forming surface of said spherical lens, in which method a foaming material layer is interposed to integrate said spherical lens and said radome and said spherical lens is supported by said radome.

7. A spherical lens supporting method of an antenna as claimed in claim 6, wherein a foaming material is charged into a space between said spherical lens and said radome and hardened, after positioning the both, thereby integrating said spherical lens and said radome through said foaming material layer.

8. A spherical lens supporting method of an antenna as claimed in claim 6, wherein a plurality of concave portions and convex portions to be engaged with each other, in a depth much smaller than the wavelength of the electric beam, are formed at least on one side, between said spherical lens and said foaming material layer or between said foaming material layer and said radome.

9. A spherical lens supporting method of an antenna as claimed in claim 6, wherein a convex portion is formed on said foaming material layer all over the peripheral portion or at a plurality of positions of a connected surface thereof with the said spherical lens, and a concave portion to be engaged with the convex portion is formed on said spherical lens at a corresponding position to the convex portion, and when connecting said foaming material layer with said spherical lens using adhesive, the convex portion is engaged with the concave portion so as to reinforce the connection of the both.

10. A spherical lens supporting method of an antenna as claimed in claim 6, wherein a projecting portion is formed on said radome all over the peripheral portion or at a plurality of positions of a connected surface thereof with the foaming material layer, and when connecting said foaming material layer with said radome using adhesive, the projecting portion is engaged with the end portion of said foaming material layer so as to reinforce the connection of the both.

11. An assembling method for use in an antenna comprising:

a spherical lens for concentrating electronic waves;

a plurality of transmitting and receiving modules of moving independently at a substantially constant distance from a bottom hemispheric surface of said spherical lens, for forming electric waves toward the center of said spherical lens and its supporting/driving mechanism; and a radome for covering at least a top hemispheric surface that becomes an electric beam forming surface of said spherical lens, characterized by interposing a foaming material layer between said spherical lens and said radome to integrate the both and supporting said spherical lens by said radome, the assembling method in which a foaming material is charged into a space between said radome and said spherical lens and hardened, after positioning the both, and said radome is fixed to a predetermined position of the antenna after integrally forming said spherical lens and said radome through said foaming material layer.

12. An assembling method of an antenna as claimed in claim 11, wherein one or a plurality of cup-shaped projecting members are used between said radome and said spherical lens for positioning the both.

* * * * *